United States Patent [19]

Hoelscher et al.

[11] Patent Number: 4,878,638

[45] Date of Patent: Nov. 7, 1989

[54] COMBINATION FREQUENCY LOOP COUPLING FOR RAILWAY TRACK SIGNALLING

[75] Inventors: James R. Hoelscher; Klaus H. Frielinghaus, both of Rochester; Frank A. Raso, Spencerport; Barry L. Smith, Rochester, all of N.Y.

[73] Assignee: General Signal Corporation, Stamford, Conn.

[21] Appl. No.: 2,369

[22] Filed: Jan. 12, 1987

[51] Int. Cl.[4] ..... B61L 21/00

[52] U.S. Cl. ..... 246/34 CT; 246/63 R; 246/122 R; 246/473 R

[58] Field of Search ..... 246/34 C, 34 R, 37, 246/63 R, 122 R, 131, 167 R, 473 R

[56] References Cited

U.S. PATENT DOCUMENTS

| | | | |
|---|---|---|---|
| 3,840,737 | 10/1974 | Hoyler | 246/63 R |
| 3,897,921 | 8/1975 | West et al. | 246/34 CT |
| 3,963,201 | 6/1976 | Brumberger et al. | 246/34 CT |
| 3,979,092 | 9/1976 | Perry et al. | 246/34 R |
| 4,053,128 | 10/1977 | Frielinghaus et al. | 246/34 R |
| 4,074,879 | 2/1978 | Clark et al. | 246/37 |
| 4,235,402 | 11/1980 | Matty et al. | 246/182 B |
| 4,304,377 | 12/1981 | Pitard | 246/34 CT |
| 4,373,691 | 2/1983 | Fricke et al. | 246/34 CT |
| 4,420,133 | 12/1983 | Dietrich | 246/167 R |
| 4,449,685 | 5/1984 | Salmon et al. | 246/8 |
| 4,487,385 | 12/1984 | Salmon | 246/122 R |
| 4,535,959 | 8/1985 | Gilcher | 246/122 R |
| 4,582,279 | 4/1986 | Pontier | 246/122 R |
| 4,641,803 | 2/1987 | Brown et al. | 246/34 CT |

*Primary Examiner*—Sherman D. Basinger
*Assistant Examiner*—Stephen P. Avila
*Attorney, Agent, or Firm*—Martin LuKacher

[57] ABSTRACT

An audio frequency (AF) track circuit whereby a railway track tuned loop transmitter operating in a dual resonant mode, for handling, two signal frequencies, can be coupled to the rails. Each frequency is conducted through a tuning unit having series and parallel branches tuned to each frequency. The track circuit using the tuned loop transmitter eliminates DC return current imbalance effects while maintaining suitably high track circuit shunting sensitivity.

18 Claims, 2 Drawing Sheets

Figure 3:
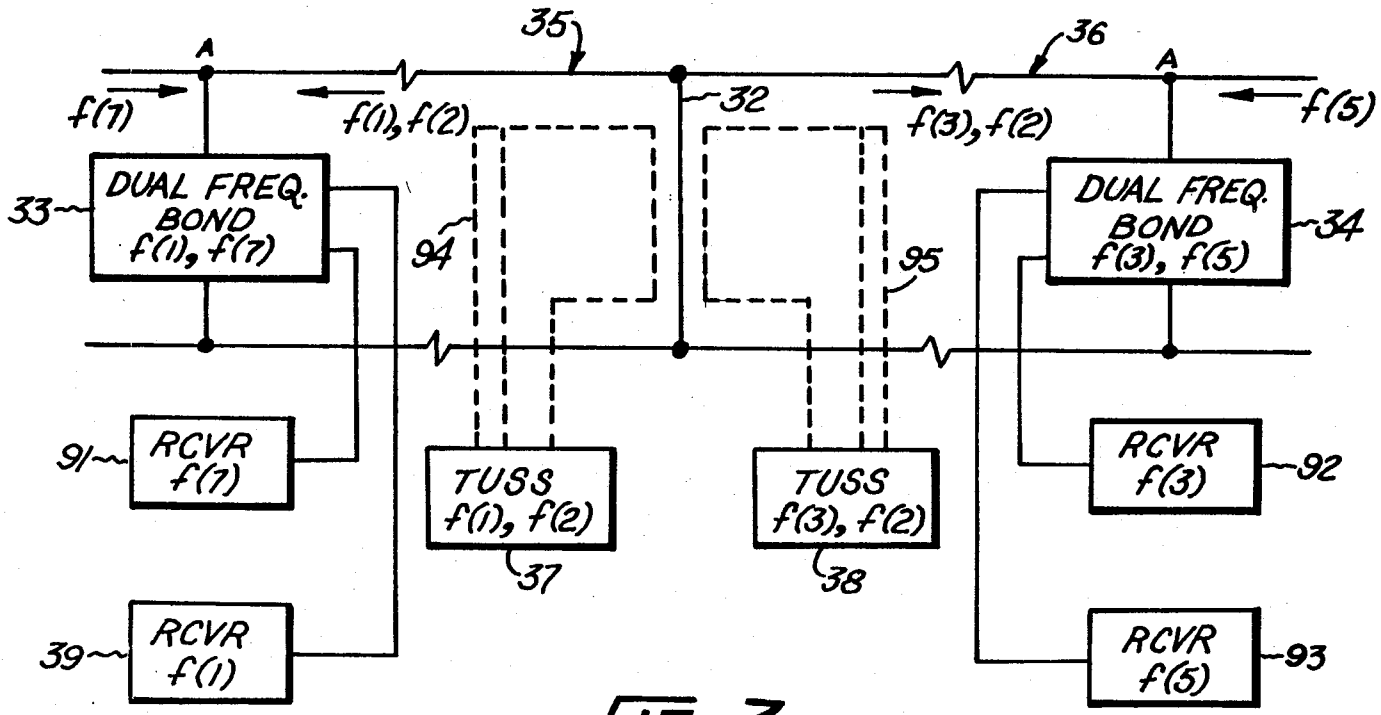

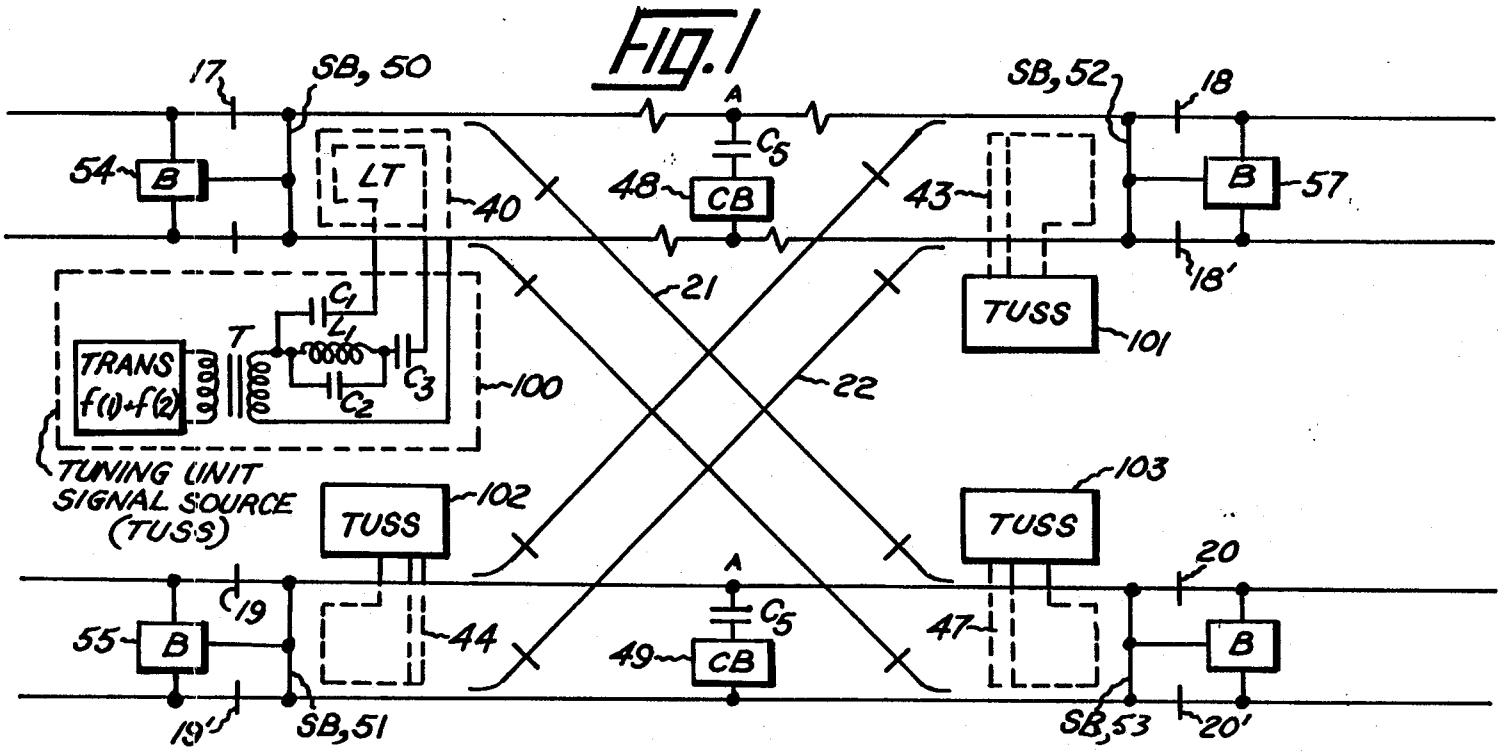
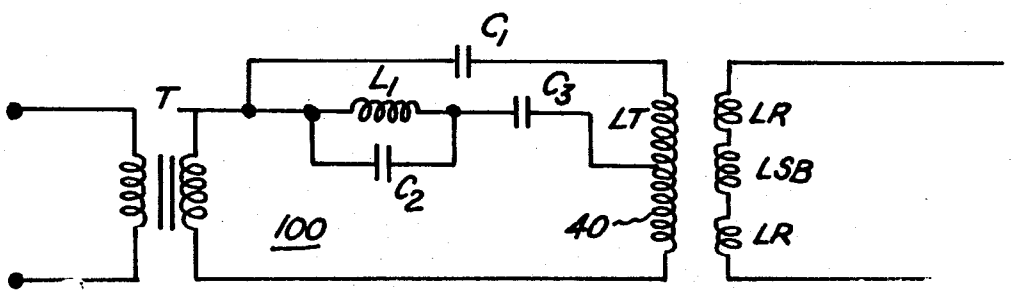
FIG. 2

COMBINATION FREQUENCY LOOP COUPLING FOR RAILWAY TRACK SIGNALLING

DESCRIPTION

The invention relates to railway signalling systems, and particularly to track circuits having plural frequency coupling circuits whereby different audio frequencies can be coupled to a track section, as for cab signalling and train detection purposes.

In track circuits, the presence or absence of a train along a designated track section under yard control is detected by means of an electrical signal transmitted onto the rails and sensed by a remote receiver. A train entering the section places a short across the rails, prevents transmission of the signal to the receiver, and causes the yard controls to operate. Simultaneously, during the presence of the train on the track a second controlling signal operating at an alternate frequency is coupled to the cab of the train via the tracks. Several circuits are needed, each for allowing transmission of a signal of different frequency in each track section. A number of track coupling techniques which have been proposed are mentioned in U.S. Pat. No. 4,373,691; issued Feb. 15, 1983. In U.S. Pat. No. 3,897,921 there is shown interlocking track circuits with audio frequency train detection and cab signalling capability. An advanced and secure method of train detection involving multiple loops and operating at different frequencies is shown in U.S. Pat. No. 4,053,128, issued Oct. 11, 1977 to K. Frielinghaus. The loops and impedance bonds described in U.S. Pat. No. 3,897,921 are untuned and therefore do not allow shunting senstivities (the highest value of impedance of the shunt across the rails provided by the wheel axle which will be detected) of greater than 0.1 ohms. On the other hand, impedance bond type audio frequency track circuits can achieve shunting sensitivities of 0.25 ohms or greater, but they cannot operate in areas where the DC imbalance currents exceed more than a few 100 amperes. In special track work areas, such as interlockings, the DC imbalance currents may exceed 1000 amperes.

It is the object of this invention to provide improved track circuits having multi-frequency signalling capability and at lower cost than with such multiple frequency loop systems as have heretofore been available.

It is another object of the invention to provide improved AF track circuits which can transmit both train detection, and cab signal frequencies through a track loop which can achieve high shunting sensitivity and which is capacitively coupled to the rails so as to obtain immunity to DC currents.

It is a further object of the invention to provide improved track circuits which obtain improved track circuit shunting sensitivity and also obtain immunity to high levels of DC imbalance currents.

These objects are accomplished in accordance with the invention by providing a combination frequency coupling for introducing multiple signals of different frequencies and enabling the flow of signal currents of different frequency along a defined section of railway track. A defined section includes the tuned loop transmitter with its shorting bar, the rail sections and an impedance bond or tuned loop used to couple the signal to the receiver. The signals can be from a track transmitter and a cab signal transmitter operating at different frequencies. The coupling provided by the invention is more economical and readily implementable than prior multi-frequency couplings, while providing adequate equivalent source impedance to allow for suitable track circuit shunting sensitivity.

Briefly, the invention provides loop coupling means whereby a coupling loop can be tuned to two different frequencies for the transmission of alternating current (preferably audio frequency) signals for train detection and transmission to a cab receiver for train control. The coupling loop is placed between the rails and adjacent to a shorting bar. This shorting bar is a heavy conductor connected between the rails to provide a return path for the electrical propulsion system and to provide increased coupling for the transmitter loop.

The loop has a split inductance arrangement and is connected to other inductive and capacitance circuit elements which are connected to be resonant at two different frequencies. The coupling loop uses no magnetic materials, thus making the coupler impervious to the DC traction return currents. This is particularly advantageous for special trackwork areas such as sections employing restraining tracks or interlockings which can cause large DC imbalance currents. The tuning elements may be economical, commercially available capacitive and inductive components. The coupling loop is constructed of standard multi-conductor cable and is placed in close proximity to the shorting bar. The bar can be tapped and used for current equalization. The bonds which can complete the track circuit section are standard tuned impedance bonds, and to prevent the flow of DC imbalance currents through them, a capacitor is placed in series with the bond primary and the rail connection. This capacitor presents a very low AC impedance while blocking all DC current flow in the bond primary. The signal receive function could also be accomplished with a tuned track receiver loop and a shorting bar, instead of a standard tuned impedance bond.

The foregoing and other objects, features and advantages of the invention will become more apparent from a reading of the following description in connection with the accompanying drawings in which:

FIG. 1 is a block diagram schematically showing a track circuit interlocking similar to that shown in U.S. Pat. No. 3,897,921 having the invention embodied therein;

FIG. 2 is a circuit diagram of a typical one of the tuning units shown in FIG. 1 showing the equivalent circuit of the inductively coupled loop, rails and shorting bar; and FIG. 3 is a block diagram of another track circuit having loop coupling means in accordance with the invention.

Referring to FIG. 1 there is shown a track circuit having an interlocking in sections defined between shorting bars (SB) and central bonds (CB). The track circuits are similar to those shown in U.S. Pat. No. 3,897,921 and reference numerals like those used in that patent in FIGS. 2 and 3 thereof are used in FIG. 1 hereof.

In accordance with this invention, the loops 40, 43, 44, and 47 are tuned via the tuning unit signal sources TUSS 100–103. The center bonds 48 and 49 are connected across the rails by capacitors C5. A track circuit is provided which is immune to DC imbalance currents, can transmit both train detection and cab signal frequencies in a single loop, and can achieve shunting sensitivities comparable to normal impedance bond type audio frequency track circuits. The performance of the interlocking track circuits of U.S. Pat. No. 3,897,921 is therefore enhanced.

As shown in FIGS. 1 and 2, the tuning units 100–103 containing elements T1, L1, C1, C2 and C3 is connected to the coupling loops 40, 43, 44, and 47 having inductance LT. These coupling loops have multiple turns (e.g., 90 turns) a tap is made to the loop (e.g. between turn 30 & 90). This circuitry has two frequency resonant points. The series circuit formed by capacitor C1 and the loop inductance LT has a resonant point at frequency f(1), where $f(1)=\frac{1}{2}\pi\sqrt{LT\ C1}$. At f(1) this series conduction path represents a low impedance to the transmitted signal. The parallel circuit formed by L1 and capacitor C2 is also chosen to be resonant at f(1), where $f(1)=\frac{1}{2}\pi\sqrt{L1\ C2}$.

Since at resonance this parallel circuit has a high impedance, this conduction path to the transmitted signal may be represented as an open circuit. Therefore at f(1) the transmitted signal is coupled to the rails via the capacitor C1 and inductance LT series tuned circuit. The equivalent source impedance of the tuned loop reflects an impedance of about 0.25 ohms into the rails, which provides a shorting sensitivity of approximately 0.25 ohms.

At a second frequency, f(2), the circuit elements C1, LT, L1 and C2 present an inductive reactance as seen in series with C2 across the secondary of the transformer T, and can be reduced to some equivalent inductance LEQ. he LRs and LSB are the equivalent inductances of the shorting bars B and rails. the capacitor C3 is then chosen to form a second resonant circuit with LEQ where $f(2)=\frac{1}{2}\pi\sqrt{LEQ\ C3}$. Thus, a second frequency f(2)) can be coupled to the rails using the same coupling loop. f(2) is greater than f(1).

Each duel frequency tuned loop has the same circuit. However, different f(1) and/or f(2) frequencies may be created by selection of the component values L1, C1, C2 and C3. Typically, different frequencies for train detection will be used in adjacent sections while the frequency used for cab signalling will be the same in all sections. The bond 48 and 49 shown intermediate the rail joints 17 and 18 and 19 and 20 in FIG. 1 is connected in series with a capacitor C5. This bond serves to couple the signal in the rails to the receiver. The capacitor C5 is included to block the flow of imbalance DC return currents through the primary of the bond. Such return currents can arise in interlocking track sections which may include other rails, as from sidings 21 and 22.

FIG. 3 shows a track without insulating joints (such as the joints 17—FIG. 1). A shorting bar 32, the rails and dual frequency bonds 33 and 34 define track circuit sections 35 and 36. These sections separately carry train detection signals of frequency f(1) and f(3). They also carry vehicle or cab signals of frequency f(2) when they are transmitted. Receivers 39 and 91 coupled to the bond 33 detect the f(1) signals and f(7) signal which are transmitted in the westerly section adjacent to section 35. Receivers 92 and 93, coupled to the easterly bond 34, detect the f(3) signals and f(5) signals in a section easterly of the section 36. Tuning unit signal sources (TUSS) 37 and 38 having the transmitters couple the signals of different frequencies f(1) or f(3) and of the frequency f(2) via loops 94 and 95 on opposite sides of the shorting bar 32. Because of the dual resonances in the tuned loop couplings at f(1), f(3) and f(2), in the TUSS 37 and 38 both f(1) or f(3) and f(2) frequencies may be transmitted in each section. The receivers in each section are sensitive to only one frequency (f(1) or f(3) for example) while the vehicle is sensitive to the common frequency f(2) for cab signalling.

The coupling bonds 48 and 49 (FIG. 1) and the dual frequency bonds 33 and 34 (FIG. 3) may be bonds which are commercially available from the General Railway Signal Co. of Rochester, New York under the name "Wee-Z Bond". Such bonds are described in U.S. Pat. No. 4,074,879. As an alternative receive function means, two single tuned loops inductively coupled to a shorting bar, could be used in place of coupling bonds 48 and 49 (FIG. 1) and dual frequency bands 33 and 34 (FIG. 3). Such alternate receive function means should be understood as included within the term "dual frequency bond".

While a perferred embodiment of the loop coupling circuit and presently preferred embodiments of track circuit systems which embody the invention have been described, it will be appreciated that variations and modifications thereof within the scope of the invention will undoubtedly suggest themselves to those skilled in the railway signalling art. Accordingly, the foregoing description should be taken as illustrative and not in a limiting sense.

We claim:

1. In a track circuit system using a coupling loop for coupling AC signals to the rails, the improvement comprising a source of signals of different frequency respectively suitable for train detection and train signalling purposes, and coupling means tunable to said different frequencies and having circuits for independently transmitting said different frequency signals in non-interferring relationship, said coupling means interconnecting said source and said loop, said loop having a plurality of turns and presents an inductance LT, and said tunable coupling means comprising a pair of circuits connected in parallel with each other to said loop, and one of which transmits one of said frequencies and the other transmits another of said frequences while blocking said one frequency.

2. The improvement according to claim 1 wherein said one of said pair of circuits has a capacitor which defines a resonant circuit including said loop at said one frequency, and said other of said pair of circuits has means defining a trap for said one frequency and a second capacitor which defines a resonant circuit including said loop at said an other frequency.

3. The improvement according to claim 2 further comprising in said coupling means a transformer having a primary connected to said source and a secondary connected to said circuits at one end of said secondary and to one end of said loop at the other end of said secondary.

4. The improvement according to claim 2 wherein said loop has a tap at a certain number of said turns, different ones of said circuits being connected to one end of said loop and to said tap, respectively.

5. The improvement according to claim 2 wherein said capacitor in said one circuit has a capacitance C1, said, trap includes a capacitor of capacitance C2 and an inductor of inductance L1 in parallel with each other, said second capacitor having a capacitance C3 and being connected in series with said trap in said other circuit, said one frequency being f(1) and said other frequency being f(2), said capacitance and inductance being defined by the following equations:

$$f(1)=\frac{1}{2}\pi\sqrt{LT\ C1}$$

$$f(1)=\tfrac{1}{2}\pi\sqrt{L1\ C2}$$

$$f(2)=\tfrac{1}{2}\pi\sqrt{C3\ LEQ}$$

where LEQ is the equivalent inductance presented across C3 by LT, the loop inductance, C1, L1 and C2 at f(2).

6. The improvement according to claim 5 wherein f(1) is greater than f(2).

7. The improvement according to claim 5 wherein said loop has a tap at a predetermined number of turns of said loop, said capacitor C3 is connected to one end of said loop and said other circuit including C1, L1 and C3 is connected to said tap.

8. A track circuit system comprising a plurality of track sections each defined by a pair of rails and a coupling bond connected between said rails at one end of each said sections and a shorting element connected across said rails at the other end of each said sections, a loop inductively coupled to each said sections coupling means connected to said loop for independently transmitting AC signals of different frequency respectively suitable for train detection and for train signalling purposes, and means capacitively coupling said coupling bond in DC blocking relationship across said rails.

9. The system according to claim 8 wherein said track sections each defines a closed circuit in which said AC signals are inductively coupled by said loop.

10. The system according to claim wherein said element is a shorting bar and said loop is disposed adjacent to said bar in inductively coupled relationship therewith.

11. The system according to claim 9 further comprising insulating joints in said rails outside said section and adjacent said element.

12. The system according to claim 11 wherein said loop coupling means has one circuit and another circuit, said one circuit having a capacitor which defines a resonant circuit including said loop at one frequency, said other circuit having means defining a trap for said one frequency and a second capacitor which defines a resonant circuit including said loop at another frequency, said capacitor in said one circuit having a capacitance C1, said trap including a capacitor of capacitance C2 and an inductor of inductance L1 in parallel, said second capacitor having a capacitance C3 and being connected in series with said trap in said other circuit, said one frequency being f(1) and said other frequency being f(2), said capacitance and inductance being defined by the following equations:

$$f(1)=\tfrac{1}{2}\pi\sqrt{LT\ C1}$$

$$f(1)=\tfrac{1}{2}\pi\sqrt{L1\ C2}$$

$$f(2)=\tfrac{1}{2}\pi\sqrt{C3\ LEQ}$$

where LT is the inductance of said loop, and LEQ is the equivalent inductance presented across C3 by LT, C1, L1 and C2 at f(2).

13. The system according to claim 12 wherein said loop coupling means each have one circuit and another circuit, said one circuit having a capacitor which defines a resonant circuit including said loop at one frequency, said other circuit having means defining a trap for said one frequency and a second capacitor which defines a resonant circuit including said loop at another frequency, said capacitor in said one circuit having a capacitance C1, said trap including a capacitor of capacitance C2 and an inductor of inductance L1 in parallel, said second capacitor having a capacitance C3 and being connected in series with said trap in said other circuit, said one frequency being f(1) and said other frequency being f(2), said capacitance and inductance being defined by the following equations:

$$f(1)=\tfrac{1}{2}\pi\sqrt{LT\ C1}$$

$$f(1)=\tfrac{1}{2}\pi\sqrt{L1\ C2}$$

$$f(2)=\tfrac{1}{2}\pi\sqrt{C3\ LEQ}$$

where LEQ is the equivalent inductance presented across C3 by LT, C1, L1 and C2 at f(2).

14. A track circuit having a pair of rails and system comprising a pair of adjacent sections defined by the rails, a shorting element connected across said rails, a first dual frequency bond connected across said rails and spaced along said rails from said shorting element in one direction, and a second dual frequency bond connected across said rails and spaced along said rails from said shorting element in the direction opposite to said one direction, receiving means connected to said first and second bonds, first and second loops respectively inductively coupled to different ones of said pair of sections at said shorting element, and loop coupling means for coupling AC signals of different frequencies separately to each of said loops.

15. The system according to claim 14 wherein said loop coupling means for one of said pair of sections has means for coupling AC signals of frequency f(1) and f(2) suitable for train detection and train signalling purposes, respectively, and said loop coupling means for the other of said pair of sections having means for coupling AC signals of frequency f(3) and f(2) is suitable for train detecting and train signalling purposes, respectively, f(1), f(2) and f(3) being different frequencies.

16. The system according to claim 15 wherein the one of said first and second dual frequency bonds defining an end of said one of said pair of sections has means responsive to the transmission of said signal of frequency f(1) and a signal of another frequency different from f(1) and f(2), and wherein the other of said first and second dual frequency bonds defining an end of the other of said sections has means responsive to the transmission of said signal of frequency f(3) and another signal of frequency different from f(3) and f(2).

17. The system according to claim 14 wherein said loop coupling means include means for reflecting sufficiently high impedance into said sections to provide shunting sensitivity of at least about 0.25 ohms.

18. In a track circuit system using a coupling loop for coupling AC signals to the rails, the improvement comprising a source of signals of different frequency respectively suitable for train detection and train signaling purposes, coupling means tunable to said different frequencies and having circuits for independantly transmitting said different frequency signals in non-interferring relationship, said coupling means interconnecting said source and said loop, and wherein said coupling means includes means for reflecting sufficiently high impedance across said rails to provide a shunting sensitivity of at least about 0.25 ohms.

* * * * *